US005527477A

United States Patent [19]

Ilardi et al.

[11] Patent Number: 5,527,477

[45] Date of Patent: Jun. 18, 1996

[54] FABRIC CONDITIONING MOLECULES DERIVED FROM GLYCEROL AND BETAINE

[75] Inventors: Leonora M. Ilardi, Englewood, N.J.; Stephen A. Madsion, New City, N.Y.

[73] Assignee: Lever Brothers Company, Division of Conopco, Inc., New York, N.Y.

[21] Appl. No.: 379,054

[22] Filed: Jan. 27, 1995

Related U.S. Application Data

[63] Continuation-in-part of Ser. No. 260,642, Jun. 16, 1994, Pat. No. 5,429,755.

[51] Int. Cl.[6] ..... D06M 13/463

[52] U.S. Cl. ..... 252/8.8; 252/8.9; 252/8.6; 252/547; 554/110

[58] Field of Search ..... 554/110; 252/8.8

[56] References Cited

U.S. PATENT DOCUMENTS

| | | | |
|---|---|---|---|
| 4,137,180 | 1/1979 | Niak et al. | 252/8.8 |
| 4,767,547 | 8/1988 | Straathof et al. | 252/8.8 |
| 4,789,491 | 12/1988 | Chang et al. | 252/8.6 |
| 4,913,828 | 4/1990 | Caswell et al. | 252/8.8 |

FOREIGN PATENT DOCUMENTS

| | | | |
|---|---|---|---|
| 568297 | 11/1993 | European Pat. Off. | 252/8.8 |
| 4013632 | 10/1991 | Germany . | |
| 92/08837 | 5/1992 | WIPO . | |
| 93/25648 | 12/1993 | WIPO | 252/8.8 |

OTHER PUBLICATIONS

Kirk–Othmer, Encyclopedia of Chem. Tech., 3rd Ed., vol. 19, pp. 521–523 and 528–531 (1980).
Organic Synthesis, vol. IV, pp 154–156 (1960).
Jaeger, D. et al., JACS, 1989, V. III, pp. 3001–3006.

*Primary Examiner*—Bernard Dentz
*Attorney, Agent, or Firm*—A. Kate Huffman

[57] ABSTRACT

Novel fabric conditioning compounds derived from glycerol and betaine are described. Compositions containing the compounds as well as the method of using the compositions is also described.

4 Claims, No Drawings

FABRIC CONDITIONING MOLECULES DERIVED FROM GLYCEROL AND BETAINE

RELATED APPLICATION

This is a continuation-in-part application of U.S. Ser. No. 08/260,642, filed Jun. 16, 1994, now U.S. Pat. No. 5,429,755

FIELD OF THE INVENTION

This invention relates to novel fabric conditioning compounds derived from glycerol and betaine which are effective softeners and are biodegradable.

BACKGROUND OF THE INVENTION

Biodegradable quaternary ammonium salts such as N,N-di(tallowoyloxyethyl)-N,N,-dimethylammonium chloride and 1,2-ditallowyloxy-3-trimethylammonio propane chloride have been developed as described in U.S. Pat. Nos. 4,137,180; 4,767,547 and 4,789,491.

Because of softening properties and ease of processing, a preferred biodegradable quaternary ammonium salt is a diester compound of the formula described in Column 1 of U.S. Pat. No. 4,137,180.

It has been discovered, however, that many of the diester compounds described above degrade to a monoester form which in certain levels can be aquatically toxic. Moreover, when the diester compounds are processed with relatively large quantities of alcohol the obtained compounds are more likely to form monoester degradation intermediates.

Thus, the need exists for novel fabric conditioning agents whose degradation products do not form monoester quaternary intermediates and thus are also environmentally friendly.

SUMMARY OF THE INVENTION

It is thus an objective of the invention to provide novel compounds which are effective fabric conditioners and whose degradation products are not aquatically toxic.

It is another objective of the invention to provide compositions containing such compounds which yield excellent fabric softening and anti-static results.

Another object is to provide novel compounds which may be formulated in a variety of physical forms, such as liquid, solid, paste, granular, powder or in conjunction with a detergent active for a single washing and softening product.

Yet another object of the invention is to provide a process for conditioning fabrics which yield good softening and anti-static results using the novel compounds of the invention.

DETAILED DESCRIPTION OF PREFERRED EMBODIMENTS

The present invention relates to novel cationic compounds having a formula:

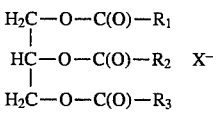

(I)

wherein $R_1$ is a $C_{15}$ to $C_{22}$ branched or straight chain alkyl or alkenyl, or hydroxyalkyl; and $R_2$ and $R_3$ are each a $C_{15}$ to $C_{22}$ branched or straight chain alkyl or alkenyl, a hydroxyalkyl or a trimethylammoniomethyl, provided that only one trimethylammoniomethyl moiety is present in the molecule; and $X^-$ is a water soluble anion; or compounds of formula II:

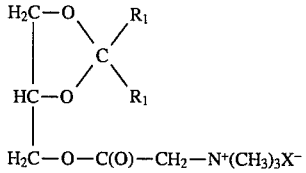

(II)

wherein $R_1$ and X are as described above for compounds of formula I.

Preferred compounds of formula I include those wherein $R_2$ is a trimethylammoniomethyl and $R_1$ and $R_3$ are each independently a $C_{15}$ to $C_{22}$ straight chain alkyl. Also preferred are compounds wherein $R_3$ is a trimethylammoniomethyl and $R_1$ and $R_2$ are each independently a branched $C_{15}$ to $C_{22}$ alkyl chain.

Most preferred compounds of formula I include those wherein $R_2$ is a trimethylammoniomethyl and $R_1$ and $R_3$ are each a straight chain $C_{15}$ to $C_{22}$ alkyl.

Examples of suitable compounds of formula I within the composition are 1,3-dioctadecanoyloxy-2 -(N,N,N-trimethylammonioacetyloxy)propane, chloride (i.e., 1,3-distearoyl 2-betainyl glycerol chloride); and 1,2-distearoyl 3-betainyl glycerol, chloride.

Preferred compounds of formula II include those wherein $R_1$ is a $C_{15-22}$ straight chain alkyl. A compound of formula II which is suitable for the invention includes 2,2-diheptadecyl-4- (N,N,N-trimethylammonioacetyloxy)methyl 1,3-dioxolane, chloride (i.e., 2,2-diheptadecyl 1,3-dioxolane 4-methyl betaine ester chloride salt).

The anion $X^-$ in the molecule is preferably an anion of a strong acid and can be, for example, chloride, bromide, iodide, sulfate, particularly methyl sulfate; the anion may carry a double charge in which case $X^-$ represents half a group.

Preparation

Compounds of formula I are prepared by reacting glycerol and an acid chloride in the presence of pyridine in a suitable solvent, such as ether, in a temperature range of about −5° C. to 5° C. A 1,3 fatty acyl glycerol is formed.

The resulting fatty acyl glycerol is reacted with a betaine compound in the presence of pyridine to form the desired compounds.

Fatty acyl glycerol can also be obtained through the hydrolysis of fat.

Compounds of formula II are prepared by reacting a glycerol ketal with a betaine compound in the presence of pyridine in a suitable solvent. Suitable solvents include methylene chloride, chloroform and toluene. The mixture is heated to a temperature of 35° C. to 50° C. for at least eight hours. The glycerol ketal starting materials are known in the art.

Fabric Conditioning Compositions

The novel compounds may be formulated in a variety of physical forms to form a fabric conditioning composition. Such a composition would comprise from about 1 to about 99 wt. % of a compound of formula I, a compound of formula II or a mixture thereof; and from about 1 to about 99 wt. % water. Preferred compounds for aqueous compositions would contain up to about 40% of the active compounds.

Such compositions may be prepared by any conventional method known in the art.

Additional Fabric Conditioning Components

It may be understood that the compounds of the invention may be combined with conventional fabric conditioning components to form a mixture of fabric conditioning actives useful in preparing fabric conditioning compositions. Such conventional conditioning agents include acyclic quaternary ammonium salts such as ditallowdimethylammonium salts, cyclic quaternary ammonium salts, particularly those of the imidazolinium type, diamido quaternary ammonium salts, tertiary fatty amines having at least 1 and preferably 2 $C_8$ to $C_{30}$ alkyl chains, carboxylic acids having 8 to 30 carbon atoms and one carboxylic group per molecule, esters of polyhydric alcohol such as sorbitan esters or glycerolstearate, fatty alcohols, ethoxylated fatty alcohols, ethoxylated fatty amines, mineral oils, polyols such as polyethyleneglycol, silicone oils and mixtures thereof. Suitable conventional fabric conditioning compounds are described in Taylor et al., U.S. Pat. No. 5,254,269, herein incorporated by reference.

Optional Components

Additionally, one or more optional additives may be incorporated in the fabric conditioning composition selected from the group consisting of perfumes, dyes, pigments, opacifiers, germicides, optical brighteners, fluorescers, anticorrosion agents and preservatives. The amount of each additive in the composition is up to about 0.5% by weight.

Detergent Formulations

It has been found that the conditioning compositions of the present invention can be incorporated into both granular and liquid detergent formulations with little detrimental effect on cleaning.

The compositions are typically used at levels up to about 30% of the detergent composition, preferably from about 5 to 20% of the composition.

Detergent Surfactant

Detergent surfactant included in the detergent formulations of the invention may vary from 1% to about 98% by weight of the composition depending on the particular surfactant(s) used and the cleaning effects desired.

Preferably, the surfactant is present in an amount of from about 10 to 60% by weight of the composition. Combinations of anionic, preferably alkyl sulfates, alkyl ethoxylated sulfates, linear alkyl benzene sulfonates, and nonionic, preferably alkyl polyethoxylated alcohol surfactants are preferred for optimum cleaning, softening and antistatic performance. It may be appreciated that other classes of surfactants such as ampholytic, zwitterionic or cationic surfactants may also be used as known in the art. As generally known, granular detergents incorporate the salt forms of the surfactants while liquid detergents incorporate the acid form where stable. Examples of surfactants within the scope of the invention are described in U.S. Pat. No. 4,913,828 issued to Caswell et al., herein incorporated by reference.

Builders, accumulating agents and soil release agents known in the art may also be used in the detergent formulations. Examples of suitable such components are described in Caswell et al., U.S. Pat. No. 4,913,828, herein incorporated by reference.

Other Optional Detergent Ingredients

Optional ingredients for the detergent compositions of the present invention other than those discussed above include hydrotropes, solubilizing agents, suds suppressers, soil suspending agents, corrosion inhibitors, dyes, fillers, optical brighteners, germicides, pH adjusting agents, enzyme stabilizing agents, bleaches, bleach activators, perfumes and the like.

The following non-limiting examples illustrate the compounds, compositions and method of the present invention. All percentages, parts and ratios used herein are by weight unless otherwise specified.

EXAMPLE 1

Preparation of 1,3-distearoyl glycerol

In a 2000 mL 3-necked round-bottomed flask equipped with a magnetic stirrer, glycerol (17.0 g, 0.185 mole) and pyridine (29.3 g, 0.370 mole) were added to 500 mL ethyl ether. The vessel was cooled to 0° C. with an ice/water bath. Stearoyl chloride (111 g, 0.185 mole) was slowly added to the chilled reaction vessel via an addition funnel. A white precipitate formed during the addition of the acid chloride. Once the addition was complete, the reaction mixture was allowed to warm to room temperature and stirring was continued for 24 hours.

After 24 hours, the reaction mixture was filtered and a white solid was collected. The crude product was dissolved in 1000 mL of $CHCl_3$ and the solution washed two times with 500 mL of water. The chloroform solution was dried over $MgSO_4$, filtered and chilled at 0° C. for 2 hours. A white solid was collected after filtering the organic layer. Yield of the product after recrystallization was 30%. Purity was 98% (NMR).

200 MHz NMR: $CDCl_3$, δ4.18 (4H, m), δ1.90 (4H, t), δ1.80-0.70 (66H, b).

EXAMPLE 2

Preparation of 1,3-dioctadecanoyloxy-2-(N,N,N-trimethylammonioacetyloxy)propane, chloride (i.e., 1,3-distearoyl 2-betainyl glycerol chloride)

Note: N-chlorobetainyl chloride was prepared as described in *Organic Synthesis*, Vol IV, pp. 154–156, herein incorporated by reference.

In a 1000 mL 3-necked round-bottomed flask equipped with magnetic stirrer and reflux condenser in which the upper end was protected with a calcium chloride drying tube, 1,3-distearoyl glycerol (41.3 g, 0.066 mole) and pyridine (10.5 g, 0.132 mole) were dissolved in 600 mL of methylene chloride. N-chlorobetainyl chloride (13.1 g, 0.076 mole) was slowly added to the reaction vessel. The reaction mixture was brought to reflux. After approximately 30 minutes the reaction was complete as monitored by NMR. The reaction mixture was filtered and the filtrate was rotary evaporated to a brown solid. The solid was dissolved in 600 mL of $CHCl_3$ and the solution was then washed with 600 mL of water. The organic layer was dried over $MgSO_4$, filtered and rotary evaporated to a solid. The solid was recrystallized from acetonitrile. Yield was 91%. Purity 95% (NMR).

200 MHz NMR: $CDCl_3$, δ5.18 (1H, t), δ4.895 (2H, s), δ4.40 (2H, d of d), δ4.05 (2H, d of d), δ3.60 (9H, s), δ2.31 (4H, t), δ1.7-0.5 (66H, b).

EXAMPLE 3

Preparation of 1,2-distearoyl 3-betainyl glycerol, chloride

Note: N-chlorobetainyl chloride was prepared as described in *Organic Synthesis*, Vol IV, pp. 154–156, herein incorporated by reference.

Following the procedure described in Example 2, 1,2-diglyceride (3.00 g, 4.80 mmol) and pyridine (0.83mL, 10.3 mmol) were dissolved in 150 mL of methylene chloride. To this was added 1.65 g (9.60 mmol) N-chlorobetainyl chloride. The reaction mixture was stirred and heated to reflux for one hour. After this time, the heat was removed and the reaction mixture was filtered. The filtrate was removed under reduced pressure leaving a white solid. This solid was solubilized in 125 mL of chloroform and washed once with 75 mL of water. The layers were separated and the aqueous layer was extracted twice with 100 mL of chloroform. The organic layers were combined and dried over magnesium sulfate. The mixture was filtered and the filtrate placed under reduced pressure. The resulting solid was recrystallized from 150 mL of acetonitrile, affording a white, solid precipitate, 2.7 g which represents a 74% yield.

EXAMPLE 4

Preparation of 2,2-diheptadecyl-4-(N,N,N-trimethylammonioacetyloxy)methyl, 1,3-dioxolane, chloride 2,2-diheptadecyl 1,3-dioxolane 4-methanol was prepared as described in Jaeger, D. et al., JACS, 1989, v. 111, pp. 3001–3006, herein incorporated by reference. N-chlorobetainyl chloride was prepared as described in *Organic Synthesis*, Vol. IV, pp. 154–156, herein incorporated by reference.

In a 1000 mL 3-necked round-bottomed flask equipped with magnetic stirrer and reflux condenser which has a calcium chloride drying tube attached to the end, 2,2-diheptadecyl 1,3-dioxolane 4-methanol (16 g, 0.0289 mole) and pyridine (4.5 g, 0.06 mole) were added to 450 mL of toluene. The solution was heated to 45° C. N-chlorobetainyl chloride (19 g, 0.03 mole) was added to the solution and the resulting mixture was heated at 45° C. for 8 hours. The reaction was then filtered and the filtrate was rotary evaporated to a white solid. The crude product was recrystallized from acetonitrile and then acetone to give a 61% yield. Purity 95% (NMR).

200 MHz: $CDCl_3$, δ5.06 (2H, s), δ4.22 (3H, m), δ3.64 (11H, s), δ1.71- 0.82 (70H, b).

EXAMPLE 5

Hydrolysis of 1,3-distearoyl 2-betainyl glycerol, chloride

A 5% dispersion was prepared by dispersing 1 gram of the cationic 1,3-distearoyl 2-betainyl glycerol, chloride in about 19 g of water at 60° C. The dispersion was allowed to cool and was analyzed for the percentage by weight of cationic over the course of several days; the active appeared stable in this dispersion at room temperature.

The hydrolysis was conducted at both pH 7 and pH 9 in separate room temperature experiments; that is, the cationic dispersion was delivered into an aqueous phosphate/NaOH buffer (50 mM) in the former and an aqueous borate buffer (12.5 mM) in the latter. In both cases, 1.4 g of cationic dispersion was delivered into a 1 L aqueous reaction medium to achieve an approximate 0.07 g/L (70 ppm) active level. Once this was accomplished, a 10 mL aliquot of solution was removed from the stock at 2 minutes, 10 minutes, 30 minutes and 60 minutes. These aliquots were extracted with 5 mL chloroform (4x) to extract the active and its hydrolysis products from the aqueous layer into an organic solvent. In order to obtain a "time 0" point, a separate sample of cationic dispersion was diluted in chloroform to achieve an approximate 70 ppm solution and this wa injected onto the HPLC system. This allowed us to observe any nonionic that was present in the cationic sample prior to hydrolysis. Any nonionic found was subtracted out from the nonionic observed in successive timed runs. The chloroform extracts were combined and the volume was adjusted to 25 mL and then injected into the LC system to determine its contents as follows:

TABLE 1

Hydrolysis of 1,3-distearoyl 2-betainyl glycerol

| Time (minutes) | pH 7 ppm cationic | pH 9 ppm cationic |
|---|---|---|
| 0 | 66 | 66 |
| 2 | 65 | 0 |
| 10 | 60 | 0 |
| 30 | 53 | 0 |
| 60 | 37 | 0 |

As can be seen from the foregoing table, the cationic active was not stable at pH 9. It decomposed in the first two minutes at room temperature. The LC analysis indicated that only diglyceride was formed and that no fatty acid was produced. Thus the betaine moiety was hydrolyzed from the product, leaving only diglyceride. Since no fatty acid was produced, no alkyl chains have been hydrolyzed from the cationic and no monoalkyl quaternary moiety formation has occurred. As noted earlier, it is known that a monoester quaternary ammonium compound is aquatically toxic.

At pH7, the same pattern was seen except the rate of hydrolysis was much slower. Only diglyceride formed with time. At typical rinse pH's, this molecule was quite stable. After one hour, 56% of the starting cationic still remained.

EXAMPLE 6

A dispersion in water containing 5% of 1,3-distearoyl 2-betainyl glycerol, chloride is prepared. 50 mL of the dispersion dispersed in 15 liters of 240 ppm hard water at 20° C. would form an aqueous fabric conditioner product.

EXAMPLE 7

A formulation containing 20% by weight 2,2-diheptadecyl-4-(N,N,N-trimethylammonioacetyloxy)methyl 1,3-dioxolane, chloride salt and 6.5% by weight dihydrogenated tallow dimethylammonium chloride is prepared by comelting the two components. Sulfuric acid is added to deionized water at a temperature of about 160° F. to form an acid solution. The comelted premixture is then added to the acidified water with stirring to form a homogeneous mixture at a temperature of 160° F. Calcium chloride is added when the product is cooled to a temperature of 120° F. to obtain a viscosity of less than about 200 cps.

We claim:

1. A composition for conditioning fabrics comprising:

a. 1 to 99 wt. % of a fabric conditioning compound of formula (i) a compound of formula (1)

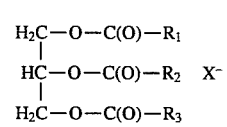

(I)

wherein $R_1$ is a $C_{15-22}$ branched or straight chain alkyl or alkenyl or hydroxyalkyl; $R_2$ and $R_3$ are each a $C_{15}$ to $C_{22}$ branched or straight chain alkyl or alkenyl, a hydroxyalkyl or a trimethylammoniomethyl, provided that one and only one trimethylammoniomethyl moiety is present in the molecule, and $X^-$ is a water soluble anion; and b. 99% to 1% water.

2. The composition according to claim 1 wherein $R_1$ is a straight chain $C_{15-22}$ alkyl.

3. A composition according to claim 1 wherein $X^-$ is selected from a group consisting of a halide, a sulfate and a nitrate.

4. The composition according to claim 3 wherein $X^-$ is selected from a group consisting of a chloride, a bromide, an iodide, and a methyl sulfate.

* * * * *